US006123237A

United States Patent [19]

Lasserre et al.

[11] Patent Number: 6,123,237

[45] Date of Patent: Sep. 26, 2000

[54] VALVE, AND PACKAGING AND DISPENSING ASSEMBLY EQUIPPED WITH SUCH A VALVE

[75] Inventors: Pierre-Andre Lasserre, Coubron; Gilles Baudin, Domont, both of France

[73] Assignee: L'Oreal, Paris, France

[21] Appl. No.: 09/314,301

[22] Filed: May 19, 1999

[30] Foreign Application Priority Data

May 29, 1998 [FR] France ..... 9806825

[51] Int. Cl.[7] ..... B65D 83/16

[52] U.S. Cl. ..... 222/402.21; 222/402.1; 222/402.22; 222/402.24

[58] Field of Search ..... 222/402.1, 402.13, 222/402.21, 402.22, 402.23, 402.24

[56] References Cited

U.S. PATENT DOCUMENTS

| | | | |
|---|---|---|---|
| 2,912,144 | 11/1959 | Luddecke | 222/402.21 |
| 3,063,462 | 11/1962 | Potash | 222/402.24 X |
| 3,495,744 | 2/1970 | Webster | 222/402.24 |
| 3,549,050 | 12/1970 | Bruce | 222/402.22 X |
| 3,618,832 | 11/1971 | Webster | 222/402.23 |
| 4,171,757 | 10/1979 | Diamond | 222/402.22 X |
| 5,785,301 | 7/1998 | Scheindel | 222/402.22 X |
| 5,967,382 | 10/1999 | Lasserre et al. | 222/402.2 |

FOREIGN PATENT DOCUMENTS

| | | |
|---|---|---|
| 2161350 | 7/1973 | France . |
| 2741933 | 6/1997 | France . |
| 2 749 568 | 12/1997 | France . |
| 2757488 | 6/1998 | France . |
| 1037377 | 8/1958 | Germany . |

*Primary Examiner*—Kenneth Bomberg
*Attorney, Agent, or Firm*—Oblon, Spivak, McClelland, Maier & Neustadt, P.C.

[57] ABSTRACT

A valve (1) for dispensing a fluid under pressure has a valve body (2) made of elastomeric material. It has an inlet passage (5) and an outlet passage (10), shut-off device (100, 19) for, in response to an actuation command, placing the inlet passage (5) in communication with the outlet passage (10), and elastic return device (20) for, in the absence of actuation command, urging the shut-off device (100, 19) into the closed position. The valve (1) has a rigid element arranged inside the inlet passage (5), a portion (109) of which emerges from the valve body (2) by a significant amount, and a part (104) forming a seal between the rigid element and the inlet passage (5).

27 Claims, 3 Drawing Sheets

VALVE, AND PACKAGING AND DISPENSING ASSEMBLY EQUIPPED WITH SUCH A VALVE

BACKGROUND OF THE INVENTION

1. Field of the Invention

The present invention relates to a dispensing valve intended to be mounted to a dispenser including a container capable of containing a product stored under pressure, particularly using a propellant gas. The invention also relates to a dispenser equipped with such a valve. This dispenser is more specifically intended for the packaging and dispensing of a fluid product such as a cosmetic, dermatological, household or food product or a workshop product, such as for example a hair lacquer, a disinfectant spray, a paint or a cleaning product. The valve according to the invention may be of the tilt type or the push-in type. It may be of the male or female type. The container on which it is to be fitted can operate head up or head down. The product to be dispensed may be pressurized by compressed (non-liquefiable) gas, by liquefiable gas, or by a piston. The gas may be nitrogen or butane.

2. Description of the Related Art

Typically, a valve consists of a valve body having an inlet passage and an outlet passage, a shut-off element for placing the inlet passage in communication with the outlet passage in response to an actuation, and an elastic return part for otherwise urging the shut-off element into the closed position.

Such valves may be equipped with an Additional Gas Intake (AGI) in the form of an orifice in the valve body and opening into the upper part of a container on which the valve is mounted, which upper part contains gas used to pressurize the liquid product. The AGI has the function of enriching the dispensed mixture with gas, which may be desirable particularly when dispensing a product in the form of a mousse or foam. Likewise, when the container is intended to operate head up, a dip tube is mounted on the valve body, one of the ends of the valve body being connected to the inlet passage of the valve body, the other end being situated more or less at the bottom of the reservoir.

Forming such an AGI and mounting a dip tube presents no difficulties when the valve body is made of a rigid or semi-rigid material such as a metal or a plastic of the polypropylene type. However, there is known from FR-A-2,161,350 a valve comprising an operating stem arranged in a valve body formed of an elastomeric material. Actuation of this valve is achieved by pushing the operating stem in axially against elastic return element. The dip tube is fixed directly to the elastomeric valve body.

Another valve of this type is described in DE-A-1,037,377. According to this document, the shut-off element has a rounded end portion of a valve stem which when tilted, causes the inlet passage to be placed in communication with the outlet passage. According to this document, the dip tube is integral with the free edge delimited by the inlet passage of the valve body. According to a particular embodiment, the dip tube forms a single entity with the valve body.

Experience has shown that having the dip tube mounted directly on the elastic valve body is not satisfactory. In practice, because of the substantial pressures inside the container, sufficiently secure attachment is difficult or impossible to achieve. Furthermore, when the valve opens, in the case of attachment as described in DE-A-1,037,377, the dip tube is subjected to relatively high stress which runs the risk of damaging it or detaching it from the valve body. What is more, it is practically impossible to produce an orifice in the elastic valve body to achieve an AGI, because of the nature of the material. In such a material, it is actually necessary to produce an orifice of a relatively large diameter in order to achieve an effective AGI. This large-diameter orifice is, however, prejudicial to the dispensing of product.

U.S. Pat. No. 3,618,832 discloses a valve made from an elastomeric material and having a valve stem which has a first portion emerging from the container so as to allow the product to be dispensed, and a second portion opposite the first, arranged in the inlet passage of the valve body and extending inside the container above the surface of the liquid. An additional gas intake is provided in the form of a passage formed axially between the exterior surface of the stem portion arranged in the inlet passage and a corresponding portion of the elastomeric valve body. One of the problems associated with a design of this kind stems from the fact that the passage thus produced is at least partially delimited by the valve body which is made of an elastomeric material, which is subject to variations in flexibility or to swelling which will alter the flow rate of additional gas entering the valve. Furthermore, even if it were not desirable to have an additional gas intake when actuating the valve, an undesirable inlet of gas between said second portion of the valve stem and the corresponding portion of the valve body would likely occur.

SUMMARY OF THE INVENTION

One object of the present invention is to provide a valve which does not display the drawbacks mentioned with reference to the conventional devices.

Another object of the invention is to provide a valve which allows precise control over any inlet of additional gas, makes it possible to prevent undesirable additional gas intake, and to control such a desired gas intake precisely.

Yet another object of the invention is to provide a valve, the valve body of which is made of an elastomeric material, and which allows simple but reliable mounting of a dip tube.

Yet another object of the invention is to provide a valve, the body of which is made of an elastomeric material and which allows an AGI to be achieved in a simple and effective way.

The above and other objects of the invention are achieved by a valve for dispensing a fluid under pressure, comprising a valve body made of elastomeric material and having an inlet passage and an outlet passage, and an actuating member having shut-off element for placing the inlet passage in communication with the outlet passage in response to an actuation. An elastic return element is provided for urging the shut-off element into the closed position in the absence of an actuation command. The valve has a rigid element arranged inside the inlet passage, a portion of which emerges from the valve body, the rigid element forming an intake duct. A seal is formed between the rigid element and the inlet passage in which the rigid element is mounted.

Thus, the only fluid flows possible are those via the intake duct passing through the rigid element. Sealing is ensured both when the valve is in the open position and when it is in the closed position. When AGI is desired, it is achieved via at least one orifice, particularly a radial orifice, placing the intake duct in communication with the container, without any portion delimited, even in part, by an elastomeric element. This makes it possible to have a relatively precise control over the AGI. Assuming that no AGI is required, any parasitic passage of gas between the exterior surface of the rigid element and the interior surface of the inlet passage is excluded due to the sealing part.

The sealing may be provided by a member held in sealed contact on the portion of exterior surface of the valve body in which said inlet passage opens. This may also make it easier to position the rigid element in the inlet passage. In addition, the rigid member may be prevented from rising up inside the valve body when such a movement is not intended. The emerging portion of the rigid element may allow the mounting of one end of a dip tube when the valve is mounted on a reservoir containing said pressurized fluid. Thus, this rigid element (as opposed to a relatively soft elastomeric material) arranged in the inlet passage and emerging inside the reservoir, allows simple and secure attachment of the dip tube. Assuming that sealing is provided by an annular bead, it is possible to limit the extent to which the dip tube is pushed onto rigid element when the dip tube is forcibly slipped onto the rigid element.

In the case of certain compositions for dispensing, it may be advantageous to provide at least one orifice in the emerging portion of the rigid element so as to produce at least one additional gas intake. The orifice thus allows the intake duct to be placed in communication with the upper part of the container containing a propellant gas. The fact that the AGI orifice is made in a rigid piece, for example of polypropylene, means that it can be dimensioned exactly to the size needed and can be adequate to fulfill its function without detracting from the correct dispensing of product. The AGI orifice may be made in the abovementioned bead. In this way, it is possible to avoid the AGI orifice being closed off by the dip tube.

According to a preferred embodiment, the rigid element is integral with the actuating member. The mounting of the valve according to the invention is greatly facilitated. Likewise, its cost is reduced by reducing the number of components.

The shut-off element may be connected, opposite the rigid element, to an emerging stem sealingly engaged inside the outlet passage and emerging from the valve body by a significant amount, the emerging stem forming a dispensing duct, a first end of which opens inside the valve body downstream of the shut-off element, and a second end of which extends outside the valve body for dispensing the fluid under pressure. Actuation of the valve stem may be either by tipping it sideways or by pushing it in. Alternatively, if the valve is of the "female" type, the shut-off element forms a central cup for receiving a male end piece of an actuating member.

The emerging stem may have a stop for limiting the amount by which the valve stem can be pushed into the valve body when the valve is actuated by pushing in a direction along its axis. Such a stop also helps with mounting the actuating member in the valve body, to make sure that it is not pushed in too far.

According to the preferred embodiment of the invention, the actuating member is formed as a single piece comprising the valve stem, the shut-off element and the element intended for mounting the dip tube and/or producing the AGI orifice. The valve is mounted in a single mounting operation, which eliminates the need for positioning each of the components inside the valve body. Typically, mounting is done by introducing the actuating member into the valve body via the outlet passage. Alternatively, the rigid element intended for mounting the dip tube and/or producing an AGI orifice may be formed as a separate element from the actuating member. It is even possible for this mounting element to be produced by two-shot injection molding with the valve body, a rigid material being used for the mounting element and an elastomeric material being used for the valve body. According to yet another alternative, the mounting element is fixed onto the valve body by attachment parts (of the barbed stake type) provided on the valve body and/or on the mounting element.

Advantageously, the part of the emerging stem inside the outlet passage has a profile capable of cooperating with a complementary profile of the outlet passage, the profiles being such that, irrespective of the angular position of the stem with respect to the axis of the valve body, the stem is in sealed annular contact with the outlet passage. Such a profile ensures good sealing whether the valve stem is one that is tipped sideways or pushed in axially. In the case of a stem that is pushed in axially, such a profile plays a part in urging the shut-off element into the closed position when the actuation command ceases.

The portion of the stem inside the outlet passage may have a part spherical portion forming a projection with respect to the rest of the stem and having a geometric center (P), the outlet passage having a portion forming an indentation of a shape that complements that of the portion forming a projection and being capable of sealingly receiving said projection-forming portion. The stem is capable of pivoting about a point of articulation of the stem which substantially coincides with the geometric center (P) in response to a force exerted substantially at right angles to the axis of the valve body. By way of an example, the annular projection-forming portion has an outside diameter of about 5 to 7 mm, the rest of the stem having a diameter of between 3 and 4 mm.

To make it easier for the stem to be tilted sideways in the outlet duct of the valve body, the distance along the axis of the stem between the point of articulation and the annular seat is advantageously between 3 mm and 4 mm. For the same reason, the valve body may exhibit, between the point of articulation and the seat, a frustoconical portion tapering towards the point of articulation.

Experience has shown that the seal is improved substantially if, when the complementary indentation is not subjected to elastic stress, it has a radius of curvature about 10% to about 30% smaller than the radius of curvature of the projection-forming portion. This is because the stem is then tightly sealed in the valve body irrespective of the angular position of the stem.

The shut-off element may be formed of a sealing ring which, in the absence of actuation, is kept bearing in a sealed manner against an annular seat formed around the outlet passage. Thus, when the operating stem is at rest, the annular seat provides perfect sealing between the exterior wall of the stem and the valve body. The ring, when the valve is in the closed position, isolates the valve body from the dispensing duct of the stem. When the operating stem is actuated against the action of the elastic return element by tilting it sideways, the ring moves partially away from the annular seat and a communication between the valve body and the outside is established, allowing the dispensing of product under pressure.

To ensure mobility of the sealing ring in the valve body, the valve body may exhibit, between the seat and the inlet passage, a frustoconical portion tapering towards the inlet passage. This frustoconical portion makes it easier for the operating stem to tilt.

According to an alternative, a portion of the stem inside the outlet passage forms a recess in the shape of an annular part toric groove with a geometric center (P), the outlet passage having a portion forming a projection of a shape that complements that of the recess and capable of receiving said annular groove in sealed manner. The stem is capable, in response to a force exerted at substantially right angles to the axis of the valve body, of pivoting about a point of articulation of the stem which coincides with the geometric center (P) of the torus.

As in the previous embodiment, sealing is improved substantially if, when the projection-forming portion is not subjected to elastic stress, this portion has a radius of curvature about 10% to about 30% smaller than the radius of curvature of the recess-forming portion.

Preferably, the distance along the stem axis between the point of articulation (P) and the annular seat is between 3 mm and 4 mm. Also preferably, the dispensing duct opens inside the valve body via a passage that passes radially through the stem. Also preferably, the valve body has external attachment parts, such as an annular groove, capable of cooperating with an opening delimited by a free edge of the reservoir.

The elastomeric material forming the valve body may exhibit a Shore A hardness in the range from 30 to 70. Thus, the valve body is both elastic enough that the actuating member can be mounted therein and rigid enough to give it stability of shape. Furthermore, when the return element is in the form of blocks borne by one of the walls delimiting the valve body, these blocks may be plastically deformed by crushing as the valve is actuated.

Advantageously, the elastic return element consist of at least one elastomeric block borne by an interior wall of the valve body and arranged in such a way that the shut-off element can, during actuation, engage elastically with said block(s). Such blocks are spaced uniformly around the entire interior surface of the valve body so as to allow the product, when the valve is in the open position, to pass between the blocks. When the valve body has an end consisting of a frustoconical portion, this (or these) block(s) is (are) arranged on this frustoconical portion. Advantageously, the number of blocks is 4 or 6. These blocks are preferably small in size compared with the chamber, for example of a height of the order of 0.5 mm to 3 mm.

The elastic return element may consist of at least one block borne by the shut-off element and capable, in response to an actuation command, of engaging elastically with a corresponding portion of the interior wall of the valve body.

According to another aspect of the invention, a dispenser has a reservoir filled with a fluid product under pressure and a valve for dispensing the product, in which the valve is formed according to the present invention. According to a particular embodiment, this dispenser does not have a metal dished part usually employed for fixing a valve to a container, and the valve is mounted directly on the neck of the reservoir. In this case, the neck is shaped in such a way that it can cooperate with the valve attachment part. The valve body can be assembled on the container without the need for a conventional dished part because the elasticity of the material of the valve body allows for the deformation needed for mounting this valve body on the container and provides a good enough seal to withstand the internal pressure of the container.

The container that can be used for mounting this valve can be made of aluminum, zinc or plastic. To this end, the container has a free edge delimiting an opening and capable of cooperating with the attachment part of the valve body.

Thus, the valve can be mounted on the container by a simple push-fitting operation and does not require intermediate parts or seals. Another advantage lies in the fact that the container can be simple and economically advantageous. To this end, the container opening in which the valve body is to be mounted may have relatively large tolerances and the valve can be mounted on the container without the need for special and expensive shaping operations.

BRIEF DESCRIPTION OF THE DRAWINGS

To make the present invention easier to understand, a number of embodiments thereof as depicted in the appended drawings will now be described by way of purely illustrative and non-limiting examples. In these drawings.

DETAILED DESCRIPTION OF THE PREFERRED EMBODIMENTS

Figure 1:
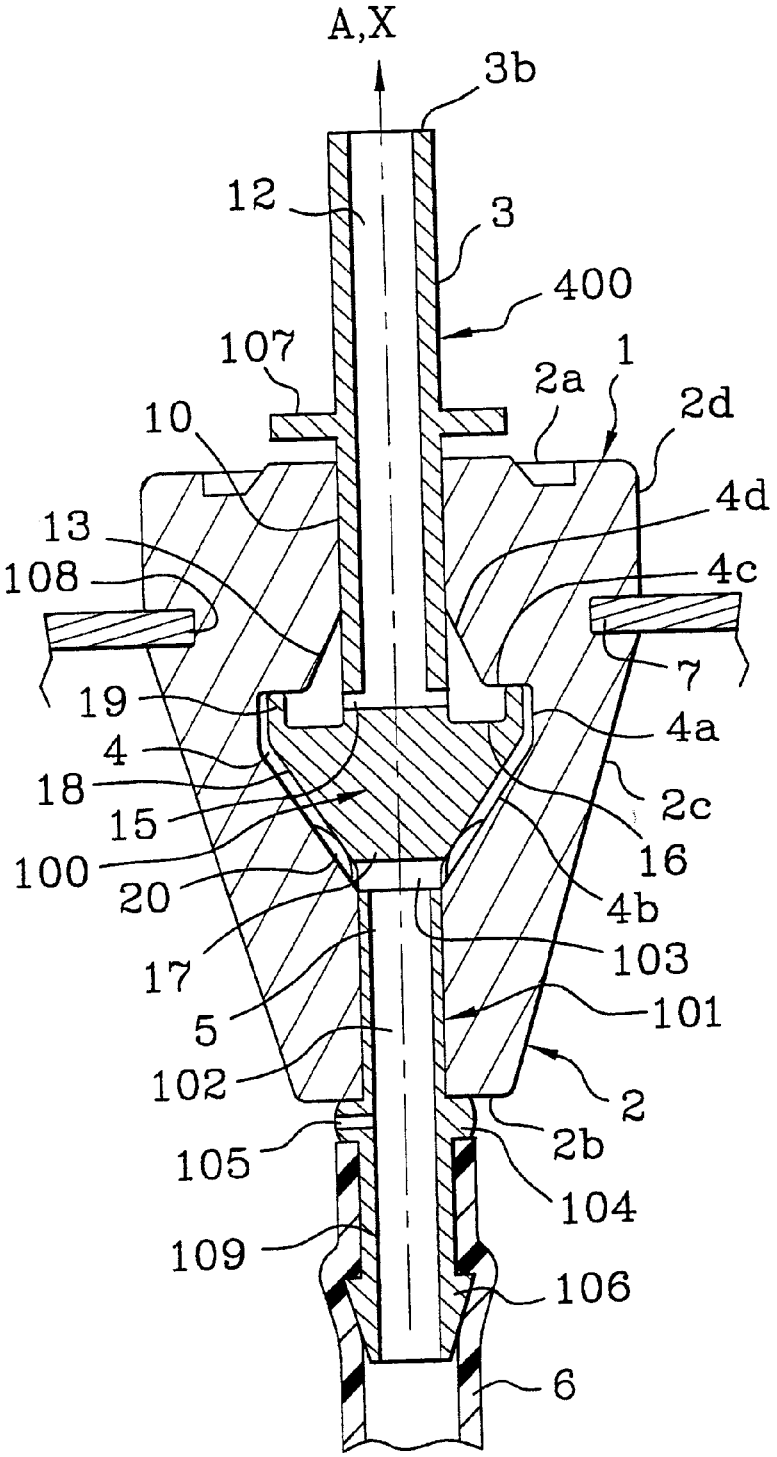
FIG. 1 is a view in section of a first embodiment of a valve according to the invention.

The valve 1 depicted in FIG. 1 is of the push-in type. It comprises a body 2 having the overall shape of a cone frustum of axis of revolution A, and an actuating member 400 comprising an operating stem 3 of cylindrical overall shape which has an axis X. When the valve is in the position of rest, the axes A and X are coincident. The actuating member 400 is made of a rigid thermoplastic material, particularly of polypropylene.

According to the invention, the valve body 2 is made of an elastically deformable material, for example a nitrile rubber elastomer, the Shore A hardness of which is in the range between 30 and 70. The body has a large base 2*a* and a small base 2*b* which are connected by a frustoconical part 2*c* and a cylindrical part 2*d*. Formed inside the valve body 2 is an internal chamber 4 delimited by side walls 4*a*, 4*b*, 4*c*, 4*d*. The wall 4*a* cylindrical and is connected to a frustoconical portion 4*b*, the vertex of which tapers towards a cylindrical inlet passage 5. On the opposite side to the frustoconical portion 4*b*, the wall 4*a* is connected, via an annular shoulder 4*c*, to a frustoconical portion 4*d* tapering in the opposite direction to the frustoconical portion 4*b*. The inlet passage 5 for the product to be dispensed is made at the center of the small base 2*b* and opens into the chamber 4.

The annular shoulder 4*c* constitutes an annular sealing region situated in a plane at right angles to the axis A. The annular sealing region continues upwards as the second frustoconical portion 4*d*. The vertex of the frustoconical portion 4*d* opens into an outlet passage 10 which is arranged in line with the inlet passage 5, the passage 10 leading from the internal chamber 4 to the outside. Arranged inside the outlet passage 10 is the stem 3 of the actuating member 400, the exterior wall of the stem 3 being in perfectly sealed contact against the wall delimiting the outlet passage 10. On the outside of the valve body, the stem 3 has an annular collar 107 capable of coming into abutment with the edge of the valve body 2 delimiting the outlet passage 10. The collar prevents the valve stem 3 from being pushed too far into the valve body 2 and limits the axial movements of the actuating member 400 when the valve stem 3 is of the push-in type.

A central dispensing duct 12 passes through the stem from the emerging end 3*b* to about the annular shoulder 4*c*. At this level, the central duct 12 ends in a passage 15 passing radially through the stem and reaching the upper part of the chamber 4. A shut-off element 100 of the actuating member 400 is integral with the valve stem 3 and placed inside the chamber 4. The shut-off member 100 is shaped as a cone frustum comprising a large 16 and a small 17 base, which bases are connected by a frustoconical part 18. The large base 16 bears a peripheral ring 19 pressing elastically in a sealed manner against the annular region 4*c*, which therefore constitutes a seat. In practice, the ring has a small radial thickness (about 0.1 to 0.5 mm, see FIG. 2). The ring 19 bears elastically against the seat 4*c* via a number of blocks 20 distributed uniformly over the frustoconical wall 4*b* of the chamber 4 and bearing elastically against the frustoconical part 18 of the shut-off element 100. Thus the free edge of the ring 19 compresses the seat 4*c* by a few tenths of a millimeter and creates a perfect seal between the valve chamber 4 and the dispensing duct 12.

According to another embodiment, the blocks 20 may be produced on the frustoconical part 18 of the element 100 of the actuating member 400 and molded integrally therewith. These blocks bear elastically against the frustoconical wall 4*b*. Thus, when the valve is actuated by tilting the stem 3, the blocks compress against the wall 4*b*.

On the opposite side to the emerging stem 3, the actuating member 400 is extended by an element 101 connected to the shut-off member 100 and inserted in sealed manner inside the inlet passage 5 of the valve body 2. The element 101 has a portion 109 extending out of the valve body by a significant amount. The element 101 forms an intake duct 102, one end of which opens axially into the reservoir, and the other end of which opens into a radial passage 103 of the actuating member 400, inside the chamber 4 near its lower portion.

The element 101 forms an integral part of the actuating member 400. According to an important feature of the invention, the portion 109 of the element 101 has an annular bead 104 in sealed contact with the edge 2*b* of the valve body 2 around the inlet orifice of the inlet passage 5, thus preventing any parasitic passage of gas to outside the element 101. Aside from sealing, the bead 104 helps keep the actuating member 400 inside the valve body 2. Furthermore, the bead 104 has a radial through passage 105 forming an additional gas intake orifice. The passage 105 opens both inside the reservoir above the level of the product so as to be in communication with the gas contained above the free surface of the product, and inside the intake duct. The bead 104 also forms an axial stop capable of limiting the extent to which a dip tube 6 can be pushed onto the free end of the element 101. Typically, the dip tube is pushed onto the free end of the element 101 by an axial length of about 5 to 7 mm. The dip tube 6 is held on the element 101 more securely by the presence of a catching barbed stake 106.

Advantageously, the actuating member 400 is made by molding a relatively rigid thermoplastic material such as polypropylene. Alternatively, the actuating member may be made of two parts joined together by any appropriate technique (bonding, welding, force-fitting, etc.).

A transition region of the valve body, which lies between the cylindrical part 2*d* and the frustoconical part 2*c* of the body 2, has an attachment part in the form of an annular fixing groove 108 capable of cooperating with a free edge 7 of the reservoir, delimiting an opening in which the valve 1 is mounted.

The valve operates as follows. By using a push-button (not depicted), the user exerts axial pressure on the actuating member 400, which pressure causes the valve stem 3 to be pushed in. The sealing ring 19 thereby separates from the seat or shoulder 4*c*. The product rises up from the reservoir through the dip tube 6, emerges in the chamber 4 through the passage 103, passes between the annular ring 19 and the seat or shoulder 4*c*, and enters the dispensing duct 12 via the radial passage 15. The product then exits through the outlet orifice 3*b*. Upon releasing the pressure on the actuating member 400, the valve stem 3, under the elastic return force of the blocks 20, rises back up until the annular ring 19 again sealingly bears against the seat 4*c*.

Figure 2:
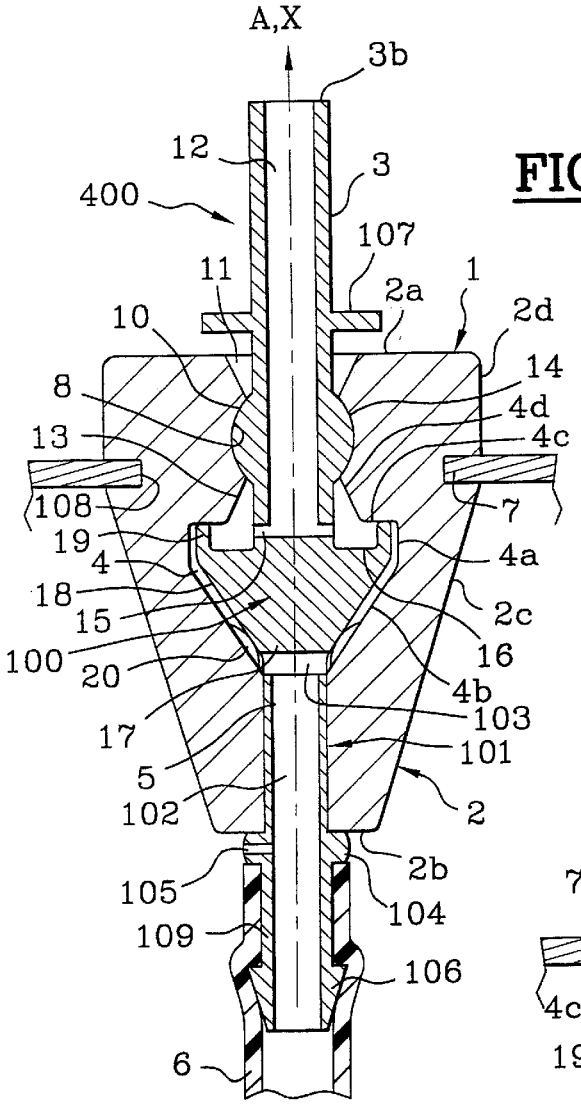
FIG. 2 is an axial section of a second embodiment of a valve in accordance with the invention, in the closed position.
Figure 3:
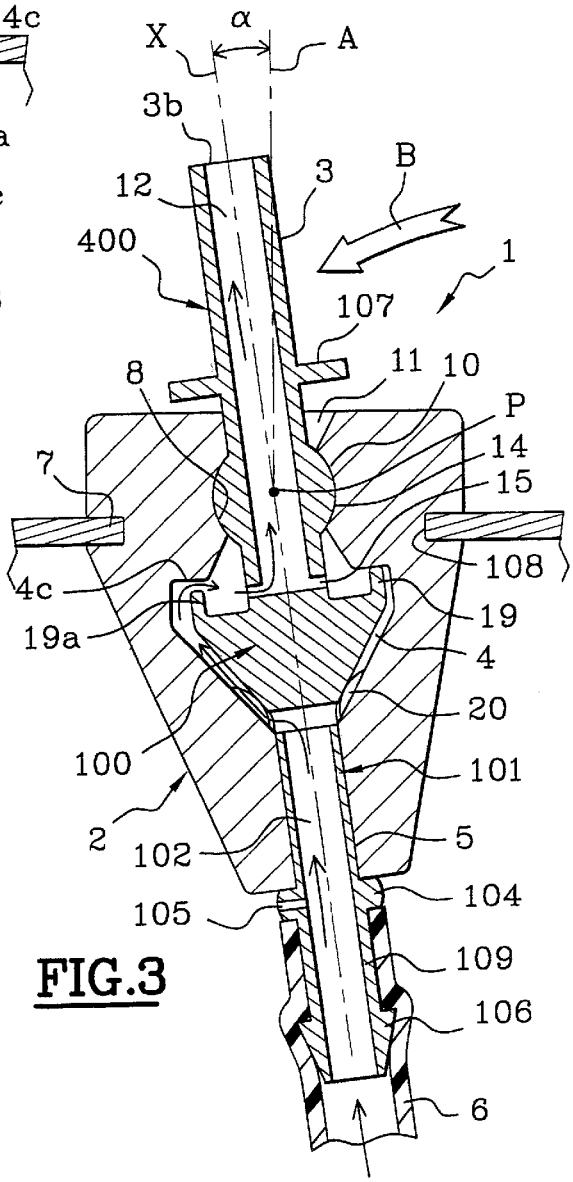
FIG. 3 is an axial section of the valve of FIG. 2, in the open position.

In the embodiment of FIGS. 2 and 3 to which reference is now made, the valve provides a better seal between the valve stem 3 and the outlet passage 10. This is particularly suitable in the case of a valve that may be tilted sideways, but is also of benefit in the case of a push-in valve. In the description which follows, only those elements which are new compared with the previous embodiment will be described in detail.

About midway along the outlet passage 10, the stem 3 has an a spherical portion 14 which projects from the rest of the stem. The shape of the spherical portion complements the shape of the indentation 8. A free end 11 of the outlet passage 10 forms a conical bore, while the other end 13 of the outlet passage forms the aforementioned frustoconical portion 4*d*.

The diameter of the stem is about 3 mm to about 4 mm, its projection-forming external spherical portion 14 having a maximum diameter of between 4 mm and 7 mm. In this case, the complementary indentation 8 formed in the outlet passage 10, when subjected to no elastic stress, has an inside diameter about 10% to 30% smaller than the outside diameter of the projection-forming portion 14. Advantageously, the center P of the projection forming portion 14 is at an axial height along the axis A that is 3 mm to 4 mm from the seat 4*c*.

The operation of the valve 1 is shown in FIG. 3. To open valve 1, the stem 3 is caused to pivot about the point of articulation P in the direction of the arrow B. During this pivoting, the axis X of the actuation member 400, and in particular of the stem 3, is inclined with respect to the axis A of the valve body, the angle $\alpha$ formed between the two axes being of the order of 2° to 10°. It should be noted that the entire valve body 2 deforms in response to this tilting of the stem 3 so that the seal between the element 101 and the inlet passage 5 is maintained throughout actuation. During this pivoting, a part 19*a* of the ring 19 moves away from the seat 4*c*. At the same time, the block (or blocks) 20 situated on the frustoconical wall 4*b* opposite the part 19*a* of the ring 19 which is moving off the seat 4*c* is (are) compressed by the frustoconical part 18 of the stem. For example, four blocks 20 of elongate shape may each have a height of about 1 mm, a width of about 1.5 mm and a length of about 1.5 mm. Under the thrust of a propellant gas, the product is then conveyed via the dip tube 6 and the duct 102 into the chamber 4 to arrive in the dispensing duct 12. When actuation ceases, dispensing of product stops because the ring 19 comes back into sealed contact against the seat 4*c*. Thus, during the pivoting of the stem in the outlet passage, this stem remains in sealed annular contact with the duct, at all or part of its spherical portion 14.

It should be noted that the valve as depicted in FIGS. 2 and 3 can be used either in tilting or in push-in mode. If the valve is used in push-in mode, the complementary profiles 8 and 14, in addition to providing a seal between the valve stem 3 and the outlet passage 10, encourage, because of their respective profiles, the return of the valve stem 3 to the closed position by an elastic return effect. Irrespective of the mode of operation, the bead 104 remains in sealed contact against the surface 2*b* of the valve body, even when the valve is being actuated, the actuating stresses being absorbed by the elastomeric material.

Figure 4:
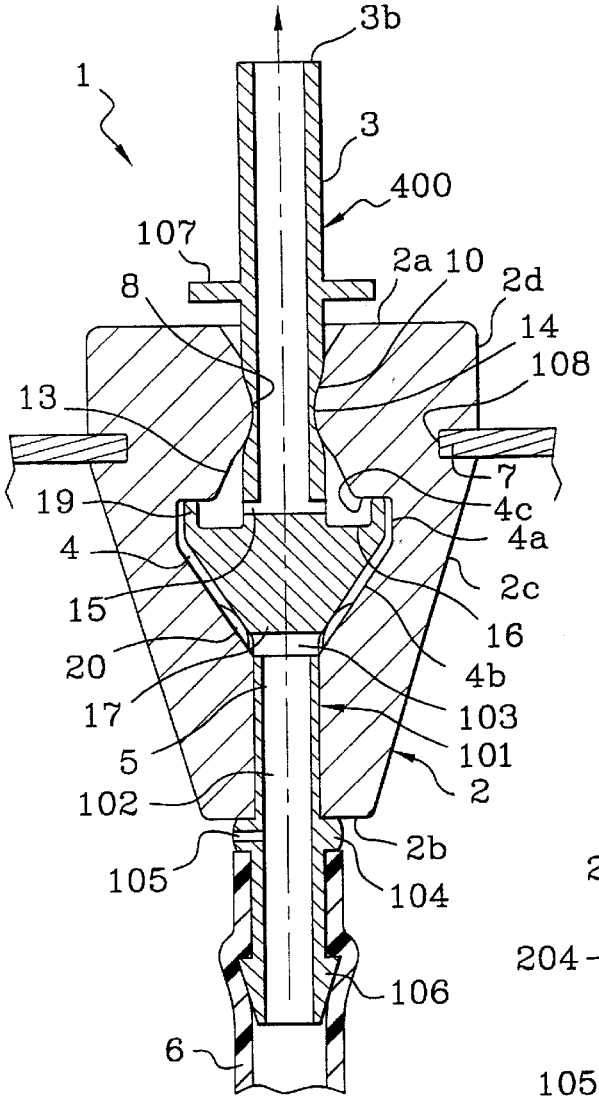
FIG. 4 is an axial section of a third embodiment of the valve in accordance with the invention.

FIG. 4 shows an alternative form of the embodiment of FIGS. 2 and 3. This valve, shown in the position of rest, is differentiated from the valve of FIGS. 2 and 3 by the fact that the shape of the profile of the spherical portion of the stem and the shape of the complementary profile of the outlet duct are reversed. As in the previous embodiments, a bead 104 bears sealingly against the surface 2*b* of the valve body so as to prevent any unintended flow of gas between the exterior of the element 101 and the interior surface delimiting the inlet passage 5. Gas can enter the valve body only via the orifice 105 passing radially through the bead 104.

Thus the stem 3 has, about mid-way along the outlet duct 10, an annular portion 14 forming a recess in the shape of a portion of a torus exhibiting a geometric center P. The outlet duct 10 has a portion 8 forming a projection of a shape that complements that of the recess 14 and capable of accommodating the annular groove in a sealed manner, the point of articulation of the stem 3 coinciding with the geometric center P of the torus. The valve according to this embodiment works in a manner similar to the valve of the embodiment of FIGS. 2 and 3.

Figure 5:
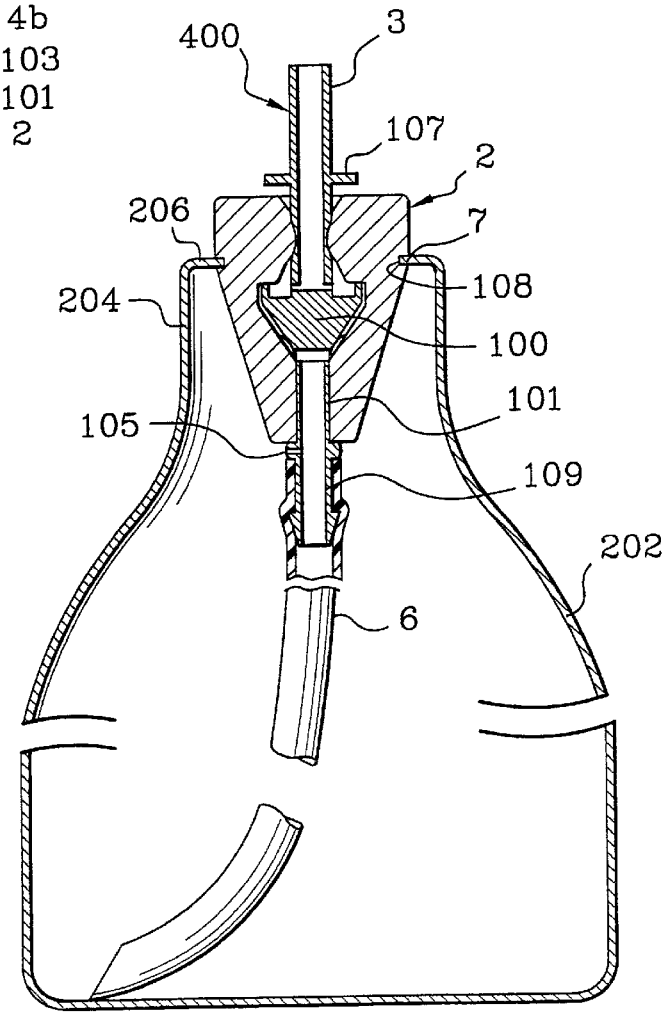
FIG. 5 is a partial axial section of a container equipped with the valve of FIG. 2.

FIG. 5 shows the valve of FIG. 4 mounted on a container 202 without a valve-holder dished element. This container is an aluminum bottle, particularly one made as a single piece, or a bottle made of a rigid plastic such as polyethylene terephthalate (PET). The container 202 has a neck 204, the open end of which is bent at right angles to form an annular shoulder 206, a free edge 7 of which delimits an orifice for mounting the valve.

The valve body 2 is push-fitted into the orifice of the container 202 in such a way that the annular shoulder 206 becomes housed in the annular groove 108 of the valve body 2. Because of the elasticity of the body 2, the latter can be mounted in the opening in the container 202 using a simple operation. In addition, when the opening has variations in diameter, the relatively large tolerances are compensated for by the elasticity of the valve body, without the risk of leaks of propellant gas. This type of mounting is particularly advantageous from an economic viewpoint.

In the detailed description, reference was made to preferred embodiments of the invention. It is obvious that variations can be made thereto without departing from the spirit of the invention as claimed hereafter.

What is claimed is:

1. A valve for dispensing a fluid under pressure, comprising:

a valve body made of elastomeric material, the valve body having an inlet passage and an outlet passage;

an actuating member comprising a shut-off element configured to close fluid communication between the inlet passage and the outlet passage when the shut-off element is in a closed position, and to open fluid communication between the inlet passage and the outlet passage when the shut-off element is moved to an open position;

an elastic return element positioned to elastically urge the shut-off element into the closed position;

a rigid intake duct element arranged inside the inlet passage, wherein a portion of the rigid intake element extends out from the valve body; and a seal element provided at a location where the rigid intake duct emerges from the valve body so as to seal the inlet passage both when the shut-off element is in the open position and in the closed position.

2. The valve according to claim 1, wherein said seal element is a bead on the rigid intake duct and in sealing contact with a portion of the exterior surface of the valve body from which said rigid inlet duct emerges.

3. The valve according to claim 2, wherein at least one gas intake orifice is formed in the portion of said rigid intake element which extends from the valve body.

4. The valve according to claim 3, wherein said orifice is in said bead.

5. The valve according to claim 1, wherein said portion of the rigid element which extends out from the valve body is mounted to one end of a dip tube of a reservoir containing the pressurized fluid when the valve is mounted on the reservoir.

6. The valve according to claim 5, wherein the portion of the rigid intake element which extends from the valve body is dimensioned to allow the dip tube to be force-fitted around said rigid intake element.

7. The valve according to claim 1, wherein said rigid intake element is integral with the actuating member.

8. The valve according to claim 7, wherein said actuating member further comprises an emerging stem sealingly positioned inside the outlet passage and connected to the shut-off element on a side thereof opposite to said rigid element, said emerging stem having a dispensing duct.

9. The valve according to claim 8, further comprising a stop positioned on the emerging stem at a position so as to limit an amount by which the emerging stem can be pushed into the valve body.

10. The valve according to claim 8, wherein the emerging stem, the shut-off element and the rigid intake element are formed from a single molded piece.

11. The valve according to claim 8, wherein a portion of the emerging stem inside the outlet passage has a profile cooperable with a complementary profile of the outlet passage such that said emerging stem is in sealed annular contact with the outlet passage irrespective of the angular position of the emerging stem with respect to the axis of the valve body.

12. The valve according to claim 11, wherein the profile is a part spherical portion, the outlet passage having a portion forming a recess of a shape that complements that of the part spherical portion and is capable of sealingly and pivotally receiving said part spherical portion.

13. The valve according to claim 12, wherein the part spherical portion has an outside diameter of about 5 to 7 mm, a remainder of the emerging stem having a diameter of between 3 and 4 mm.

14. The valve according to claim 12, wherein said complementary recess, when not subjected to any elastic stress, has a radius of curvature about 10% to about 30% smaller than the radius of curvature of the part spherical portion.

15. The valve according to claim 11, wherein the profile is a recess in the shape of a part torus, the outlet passage having a portion forming a projection of a shape that complements that of the part torus portion and is capable of sealingly and pivotally receiving said part torus portion.

16. The valve according to claim 15, wherein when the projection portion, when not subjected to any elastic stress, has a radius of curvature about 10% to about 30% smaller than the radius of curvature of the part torus portion.

17. The valve according to claim 1, wherein the shut-off element includes a sealing ring urged by said elastic return element to sealingly bear against an annular seat formed by said valve body.

18. The valve according to claim 12, wherein a distance between a point of articulation of the part spherical portion and an annular seat of the valve body is between 3 mm and 4 mm.

19. The valve according to claim 12, further comprising a frustoconical portion of the valve body located between a point of articulation of the part spherical portion and an annular seat of the valve body, the frustoconical portion tapering towards the point of articulation.

20. The valve according to claim 17, wherein the valve body exhibits, between an annular seat of the valve body and the inlet passage, a frustoconical portion tapering towards the location where the rigid intake duct emerges from the valve body.

21. The valve according to claim 8, wherein the dispensing duct opens inside the valve body via a passage that passes radially through the emerging stem.

22. The valve according to claim 1, wherein the valve body has an attachment part cooperable with an opening delimited by a free edge of reservoir to attach the valve body to the reservoir.

23. The valve according to claim 22, wherein the attachment part comprises an annular groove.

24. The valve according to claim 1, wherein the elastomeric material forming the valve body has a Shore A hardness in the range from 30 to 70.

25. The valve according to claim 1, wherein said elastic return element comprises at least one elastomeric block borne by an interior wall of the valve body, and arranged such that the shut-off element is elastically engagable with said at least one block.

26. The valve according to claim 1, wherein the elastic return element comprises at least one block borne by the shut-off element, and elastically engagable with a corresponding portion of the interior wall of the valve body.

27. A dispenser comprising a reservoir filled with a fluid product under pressure and a valve for dispensing the product, wherein the valve comprises:

a valve body made of elastomeric material, the valve body having an inlet passage and an outlet passage;

an actuating member comprising a shut-off element configured to close fluid communication between the inlet passage and the outlet passage when the shut-off element is in a closed position, and to open fluid communication between the inlet passage and the outlet passage when the shut-off element is moved to an open position;

an elastic return element positioned to elastically urge the shut-off element into the closed position;

a rigid intake duct element arranged inside the inlet passage, wherein a portion of the rigid intake element extends out from the valve body; and a seal element provided at a location where the rigid intake duct emerges from the valve body so as to seal the inlet passage both when the shut-off element is in the open position and in the closed position.

* * * * *